US005373676A

United States Patent [19]

Francis et al.

[11] Patent Number: 5,373,676

[45] Date of Patent: Dec. 20, 1994

[54] THIN BRICK PANEL ASSEMBLY

[76] Inventors: Steven R. Francis, 6824 Deerhill Dr., Clarkston, Mich. 48346; Gerald T. Francis, 5744 Cowell, Brighton, Mich. 48116; Robert G. Francis, 20994 W. Farm La., Northville, Mich. 48167; Gregory J. Francis, 19354 Wakenden, Redford, Mich. 48240

[21] Appl. No.: 952,021

[22] Filed: Sep. 28, 1992

[51] Int. Cl.[5] ..... E04F 13/08

[52] U.S. Cl. ..... 52/387; 52/386; 52/389; 52/506.05

[58] Field of Search ..... 52/506, 386, 387, 389

[56] References Cited

U.S. PATENT DOCUMENTS

| | | | |
|---|---|---|---|
| 555,358 | 2/1896 | Balsley . | |
| 814,134 | 3/1906 | Hood . | |
| 923,507 | 6/1909 | Gibson . | |
| 1,076,836 | 10/1913 | Merwin . | |
| 1,662,177 | 3/1928 | Williams . | |
| 1,791,639 | 2/1931 | Robinson . | |
| 1,939,528 | 12/1933 | Swift . | |
| 2,021,922 | 11/1935 | Peck . | |
| 2,213,355 | 9/1940 | Woodworth . | |
| 2,317,428 | 4/1943 | Anderson . | |
| 2,648,103 | 8/1953 | Wahlfeld . | |
| 2,732,705 | 1/1956 | Ray . | |
| 2,791,117 | 5/1957 | Bailey . | |
| 2,919,572 | 1/1960 | Salzi . | |
| 2,924,963 | 2/1960 | Taylor et al. . | |
| 2,938,376 | 5/1960 | Workman et al. . | |
| 3,045,293 | 7/1962 | Potchen . | |
| 3,102,366 | 9/1963 | Slowinski . | |
| 3,131,514 | 5/1964 | Siek . | |
| 3,331,180 | 7/1967 | Vissing et al. . | |
| 3,533,206 | 10/1970 | Passeno, Jr. . | |
| 3,608,263 | 9/1971 | Gartner . | |
| 3,646,715 | 3/1972 | Pope . | |
| 3,675,383 | 7/1972 | Paoletti . | |
| 3,701,228 | 10/1972 | Taylor | 52/386 |
| 3,740,909 | 6/1973 | Stinnes . | |
| 3,884,737 | 5/1975 | Bransford, Jr. . | |
| 3,908,326 | 9/1975 | Francis . | |
| 4,069,636 | 1/1978 | Kessler . | |
| 4,156,993 | 6/1979 | Sorrells, Jr. . | |
| 4,299,069 | 11/1981 | Neumann . | |
| 4,407,104 | 10/1983 | Francis . | |
| 4,641,473 | 2/1987 | Trezza . | |
| 4,809,470 | 3/1989 | Bauer et al. | 52/387 |
| 4,858,410 | 8/1989 | Goldman | 52/387 |
| 4,890,433 | 1/1990 | Funaki | 52/386 |

FOREIGN PATENT DOCUMENTS

| | | | |
|---|---|---|---|
| 1094284 | 1/1981 | Canada . | |
| 816889 | 7/1949 | Germany . | |
| 176249 | 3/1921 | United Kingdom . | |
| 928800 | 8/1961 | United Kingdom . | |
| 1210498 | 10/1970 | United Kingdom | 52/387 |
| 1478863 | 7/1977 | United Kingdom . | |

*Primary Examiner*—Carl D. Friedman
*Assistant Examiner*—Christopher Todd Kent
*Attorney, Agent, or Firm*—Howard & Howard

[57] ABSTRACT

A thin brick panel assembly for forming a brick facing on a building includes a backing member formed from of a single sheet of material which is adapted to properly retain individual thin brick tiles, and support clips utilized in supporting the completed brick facing. The backing member has a uniform cross-section throughout its entire length, and provides channels which allow the thin brick tiles to lay uniformly across each row. Support clips secure the completed brick facing to an underlying support structure of the building.

7 Claims, 1 Drawing Sheet

THIN BRICK PANEL ASSEMBLY

BACKGROUND OF THE INVENTION

This invention relates generally to the construction of a brick facing, and in particular to improvements in the components used in securing the thin brick facing onto a building structure.

As is well known, thin bricks are used in place of standard bricks to create a brick facing on building structures. These exterior brick surfaces are not intended to be load bearing, and primarily serve an aesthetic function. The use of standard load bearing bricks can be expensive in that the bricks themselves, being larger, require additional material in forming. Further, laying standard sized bricks requires highly trained masons who have developed expertise in brick laying. The process is time-consuming, and most individuals lack the requisite skills.

Thin bricks have the advantage of being easier to install. Generally, the assemblies have an insulation board or backing board to which thin bricks are mounted. The backing board is attached to supporting structure on the building and mortar is then applied in the joints between the bricks. In one type of system, brick panels are pre-fabricated by gluing the thin bricks to the backing board. The pre-fabricated brick panels are then transported to the job site to be attached to the building. This type of system is disclosed in U.S. Pat. No. 4,407,104.

In the assembly disclosed in the '104 patent, support clips connect the brick assembly to the underlying building support structure. The brick tile facing, through the use of these clips, can then be supported independent of the backing member. Although commercially successful, a disadvantage of this system is that the pre-fabricated brick panels are difficult to transport, and are difficult to cut into desired shapes. Use of pre-fabricated brick panels is particularly undesirable for a person doing smaller home-improvement projects.

As an alternative, attempts have been made to provide a more manageable system adjusted particularly for the home-improvement user. A system that has smaller disassembled pieces which can be packaged more easily and assembled at the job site. Such a brick facing system can be constructed at less cost, and the individual components are transported more easily.

One such attempt at providing a brick panel system requiring assembly includes a backing member having an insulation layer and a separate plastic face which must be attached to the insulating layer. See U.S. Pat. No. 4,809,470. The plastic face contains channels for aligning brick tiles into rows. These two layer backing members are more complicated and thereby more costly to produce than a backing member formed of a single material. Also, the channels are believed to be more rigid and less receptive to bricks having varying widths which is sometimes a problem.

The use of a backing member formed from a single sheet of material is known. Great Britain Patent GB 1478863 discloses a backing member formed from a foam insulation sheet which includes channels formed directly in the sheet. The channels are adapted to retain individual brick tiles. The channels further include projections which extend transversely into an adjacent channel to provide resistance to hold the brick tile.

The difficulty with this type of panel is that the transversely extending projections can cause difficulties with placing the thin brick tile fully into the channel. If the brick tiles do not lay uniformly and properly within the channel of the backing member, the completed brick wall will have an uneven, undesirable finish.

It is therefore an object of this invention to provide an improved backing member adapted to uniformly retain standard thin brick tiles, the backing member being formed of a single insulating sheet which can be easily and inexpensively formed in mass production. It is a further object of this invention to provide a support clip which can be used in conjunction with this backing member to easily connect the insulating sheet to an underlying support structure and which when mortared will directly connect the bricks to the underlying structure.

SUMMARY OF THE INVENTION

The present invention discloses improvements in constructing a brick facing on a building structure. The brick facing assembly includes an improved backing member adapted to retain thin brick tiles within channels, and improved support clips which are used to initially secure the backing member and ultimately the completed brick facing to an underlying support structure of the building.

The backing member is formed from a single sheet of material which has channels cut directly into an insulation layer in order that rectangularly-shaped thin brick tiles may be received uniformly throughout each channel. Support clips in the channels have direct contact with the thin brick tile, and extend into the mortar area. The support clips are fastened to an underlying support structure of the building. The thin brick tiles are easily placed flat against the uniformly smooth area of the channel which is adjacent to the rear surface of the thin brick tile. Mortar is then placed between the individual brick tiles to form the brick facing. The support clips extend into the mortar.

The backing member includes parallel holding guides which extend outwardly to define the channels. One side of the holding guide is generally perpendicular to the insulate base, and provides for facial contact with an adjacent thin brick tile. Another side of the holding guide is under-cut so that the side is angled outwardly towards the channel. The under-cut side provides a knife-like edge for line contact with adjacent thin brick tiles. The arrangement allows for a thin brick tile to be snapped into the channel, having enough resistance to hold the thin brick tile, but not so much resistance as to prevent the thin brick tile from being fully received in the channel.

Further, the backing member has a substantially identical cross-section along its entire length allowing channels to be cut into an original sheet by a hot wire cutting process. With this design, the backing member can be easily and cost effectively mass produced.

Support clips are used to directly connect the brick facing to the building structure. The support clips include a rear plate which is disposed between a brick tile and the backing member and which extends along a back surface of the thin brick tile. A shelf extends from an edge of the rear plate to provide direct vertical support for the brick tile. Teeth extend from an edge of the shelf into the mortar area between individual brick tiles. The teeth are spaced from each other to provide a locking means for the support clip to be solidly embedded into the mortar area.

These and other features of the present invention can best be understood from the following specification and drawings, of which the following is a brief description.

DETAILED DESCRIPTION OF THE PREFERRED EMBODIMENT

Figure 1:
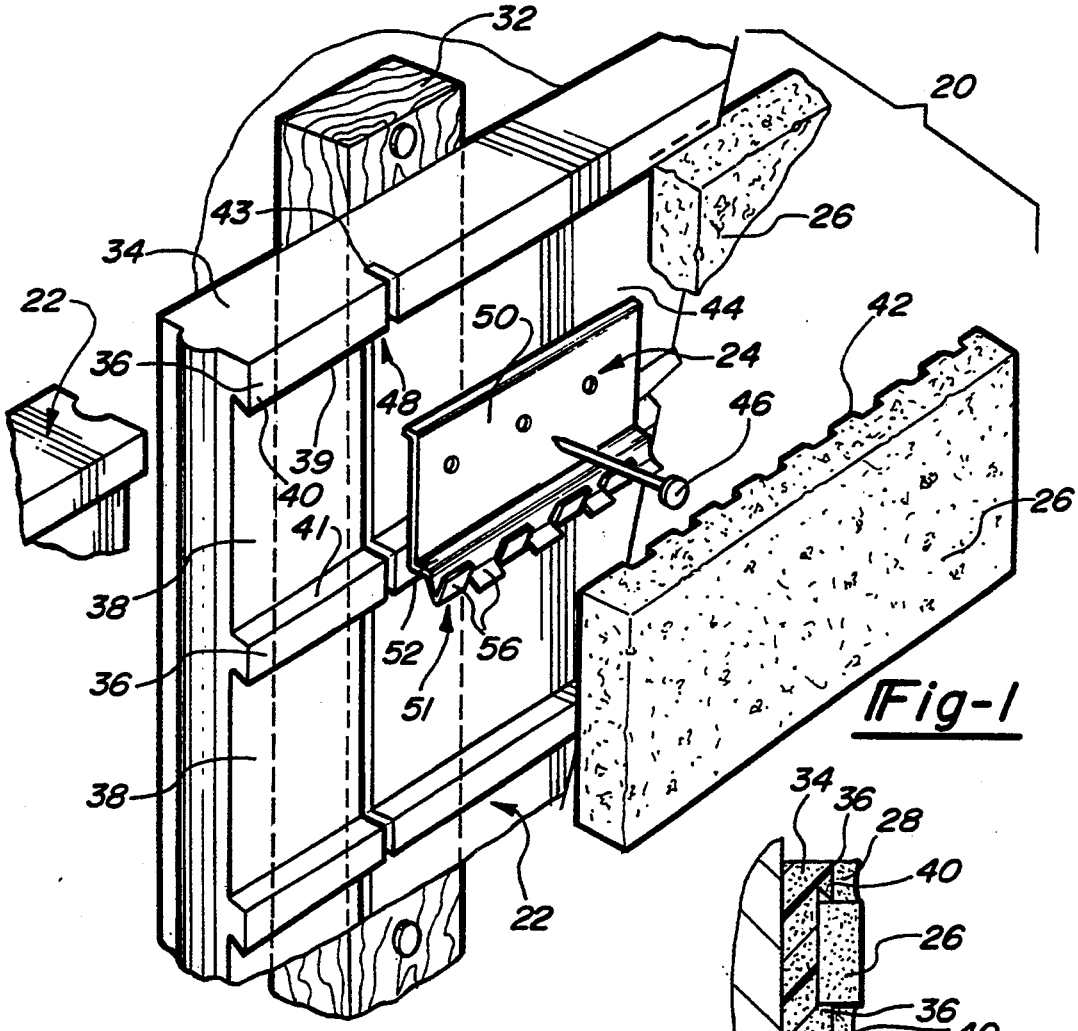
FIG. 1 is an exploded perspective view of the thin brick panel assembly.
Figure 2:
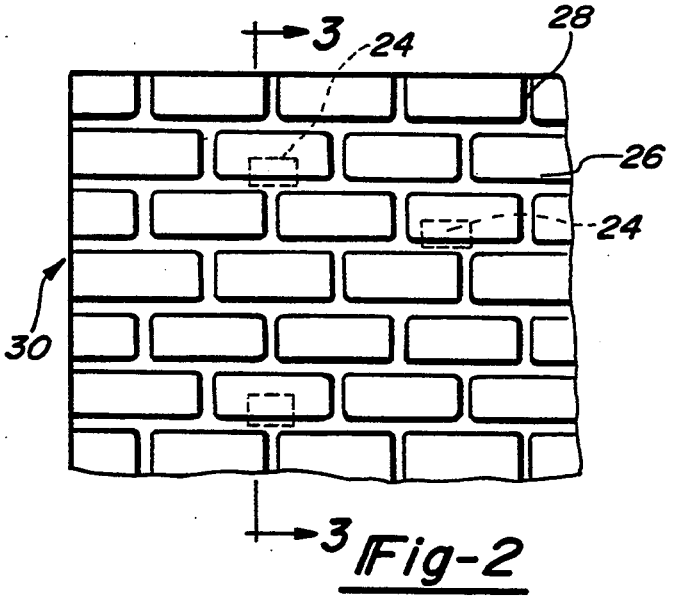
FIG. 2 is a front view of a completed brick facing incorporating the present invention.
Figure 3:
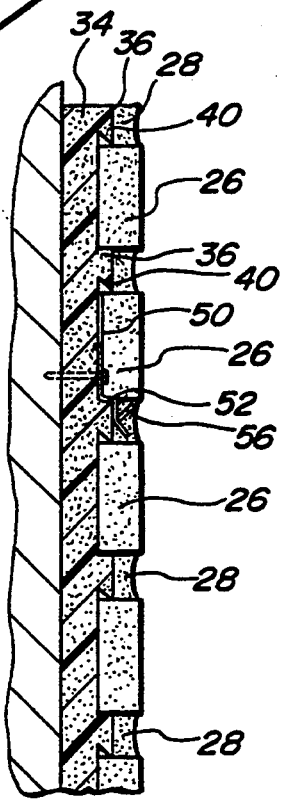
FIG. 3 is a cross-sectional view substantially along line 3—3 of FIG. 2.

Referring now to FIGS. 1-3, an inventive thin brick panel assembly 20 includes a backing member 22, support clips 24 and individual thin brick tiles 26. Mortar 28 is applied along the area between the thin brick tiles 26 to form a brick facing 30. Support clips 24 are used during assembly to initially anchor the backing member 22 and ultimately the completed brick facing 30 to the underlying building structure 32.

The backing member 22 is formed from a single sheet of material. Backing member 22 includes an insulate base 34 and generally parallel holding guides 36 which extend outwardly from and are integral to the insulate base 34. The holding guides 36 are spaced to define channels 38. One side 39 of the holding guide 36 is angled to form a knife edge 40 which extends into adjacent channel 38. Knife edge 40 retains thin brick tiles 26 within channel 38, and also allows accommodation of tolerances in the size of thin brick tiles 26. Another side 41 of the holding guide 36 is generally perpendicular to the insulate base 34. A generally vertical groove 43 is formed in backing member 22 to allow water to drain. The groove 43 is preferably on 16 inch centers and has a depth of ⅛ inch into the channel 38. As should be understood, the groove 43 extends through sides 39 and 41 as well as into backing member 22 ⅛ inch.

The channels 38 of the backing member 22 are formed by cutting directly into an original sheet of insulation material. The knife edge 40, in particular, is formed by cutting side 39 of the holding guide 36 at an angle inwardly from a top portion of the holding guide 36. Side 39, having the knife edge 40, forms an acute angle with the channel 38. This design permits knife edge 40 to have line contact with a shin brick tile 26, in order to provide sufficient resistance to retain a thin brick tile 26 within channel 38, but not excessive resistance which would prevent channel 38 from fully receiving the brick tile 26. This knife edge 40, in connection with a standard thin brick tile, permits the thin brick tile 26 to "snap" into channel 38.

The channel 38 is generally uniform and flat along the area defined by insulate base 34, which is adjacent to the back portion 42 of a thin brick tile 26. This also assures that thin brick tiles 26 lay uniformly within channels 38.

In constructing the brick facing 30, the pre-cut backing member 22 is first positioned along the building structure 32. Support clips 24 are then placed on an outer surface 44 of backing member 22 in, for example, a pattern illustrated in FIG. 3, and are attached by a fastening means 46, such as a nail. The fastening means 46 passes through backing member 22 into the building structure 32, allowing support clip 24 to remain on the outer surface 44 adjacent to thin brick tile 26. In addition to securing the backing member 22, support clip 24 provides a means for the brick facing 30 to be directly attached to the building structure 32 independent of the backing member 22. This is accomplished by having portion 51 of the support clip 24 extend into the area between individual thin brick tiles 26 which receives mortar 28. This will be discussed in greater detail below.

In order to insert the thin brick tiles 26 into channels 38, the thin brick tiles 26 are first placed against side 41 of the holding guide. The thin brick tile 26 is then snapped completely into the channel 38, causing knife edge 40 to deform slightly. In the preferred method of assembly, glue is applied to the bricks or channel to ensure that the bricks 26 are secured in channel 38. Mortar 28 is then applied to the area between thin brick tiles 26, embedding portion 51 of support clip 24. Once mortar 28 is set and hardened, the brick facing 30 is secured through the clip 24 to the building structure 32.

The support clip 24 includes a rear plate 50 which is intended to be disposed between the thin brick tile 26 and backing member 22. In the preferred embodiment, Rear plate 50 extends greater than one-half the distance of the back portion 42 of thin brick tile 26. A shelf 52 extends from an edge of rear plate 50 and abuts side 41 of the holding guide 36. Shelf 52 has facial contact with a portion of thin brick tile 26 and provides direct vertical support. The rear plate 50 and shelf 52 combine to provide significant direct facial contact with the thin brick tile 26, proving firm support. Portion 51 includes teeth 56 which extend from an edge of shelf 52 into the mortar area between individual brick tiles 26. Teeth 56 are alternately angled from shelf 52 to form rows, allowing the teeth in each row to be spaced from each other, and to resist loads applied to the brick facing 30. Each tooth 56 is embedded in the mortar 28 on three sides to ensure that portion 51 is locked into the mortar 28.

The backing member 22 has a longitudinal dimension defined by the holding guides 36 extending along a longitudinal axis and has a uniform cross-section along the entire longitudinal dimension. Since backing member 22 has a uniform cross-section along the entire longitudinal dimension, channels 38 can be cut directly into the original sheet of material by a hot wire cutting process. This design and process allows the backing member 22 to be easily and inexpensively mass produced.

Preferably, backing members 22 includes tongue and groove joints along the edges to improve structural integrity. Each backing member 22 includes a tongue 58 extending from one edge. An adjacent backing member 22 includes a groove 60 on a corresponding edge which aligns to receive tongue 58.

Preferably, the original sheet of material forming the backing member 22 is extruded polystyrene. In one embodiment, the insulate base 34 is approximately ¾ inches thick, the holding guides 36 extend approximately 3/16 inch from the insulate base 34 and the thin brick tile 26 is approximately ½ inch thick, providing approximately 5/16 inch of thickness for mortar 28. The support clips 24 are formed of metal.

A preferred embodiment of the present invention has been disclosed. A worker of ordinary skill in the art, however, would recognize that certain modifications would come within the scope of this invention. For that reason, the following claims should be studied in order to determine the true scope and content of this invention.

What is claimed is:

1. A brick assembly utilized in providing a self-supporting thin brick facing on a building structure, comprising:

a plurality of generally rectangular shaped thin brick tiles having opposed side edges, a top and a bottom surface;

a support panel for supporting said thin brick tiles, said support panel having a plurality of retaining channels for retaining said thin brick tiles, said retaining channels having a base and first and second opposed sides defined by laterally spaced, longitudinally extending holding guides, said holding guides being laterally spaced and generally parallel to one another, solid and integrally formed from said support panel; said holding guides having first and second sides, said first side extending outwardly and toward said second side at an acute angle with said channel to form a knife edge extending from an outer portion of said holding guide into said channel, said knife edge being adapted to deform to frictionally retain said thin brick tile, said knife edge providing generally line contact with said thin brick tile along one of said opposed side edges, said second side being generally perpendicular to said channel providing a flat surface for facial contact against the other opposed side edge of said thin brick tile, said bottom surface of said thin brick tile being in generally facial contact with said base of said retaining channel;

said holding guides defining the lateral dimension of a respective channel; said lateral dimension of said channel being slightly less than the lateral dimension of said thin brick tiles;

said thin brick tiles being inserted into said channels between said holding guides, said thin brick tiles deforming said knife edge of said first side of said holding guide while facially contacting said second side and said base;

whereby said support panel is adapted to be attached to a building structure and said thin brick tiles being snapped into said channels and held in place within said channels by said holding guides.

2. The brick assembly as recited in claim 1, wherein said guide members, and said support panel are formed from a foam material.

3. The brick assembly as recited in claim 1, wherein said backing member is formed of polystyrene.

4. The brick assembly as recited in claim 1, wherein said backing member includes a support clip adapted to secure said thin brick tile to said building structure, said support clip including a rear plate disposed between said thin brick tile and said backing member, a shelf portion extending from an outer edge of said rear plate and supporting said brick tile, said support clip having a portion extending from an edge of said shelf into the mortar area between said thin brick tiles, said support clip being adapted to be connected to said building structure by a fastening means extending through said backing member.

5. The brick assembly as recited in claim 4, wherein said support clip includes teeth extending from said shelf, said teeth extending at alternating angles to form at least two rows thereby resisting loads on said brick facing.

6. The brick assembly as recited in claim 1, further including drainage grooves formed in said backing member, said drainage grooves being generally vertical.

7. A brick assembly utilized in providing a self-supporting thin brick facing on a building structure, comprising:

a plurality of generally rectangular shaped thin brick tiles having opposed side edges, a top and a bottom surface;

a support panel for supporting said thin brick tiles, said support panel having a plurality of retaining channels for retaining said thin brick tiles, said retaining channels having a base and first and second opposed sides defined by laterally spaced, longitudinally extending holding guides, said holding guides being laterally spaced and generally parallel to one another, and integrally formed from said support panel; and said support panel including a support clip adapted to secure said thin brick tile to a building structure, said support clip including a rear plate disposed between said thin brick tile and said support panel, a shelf portion extending from an outer edge of said rear plate and adapted to support said brick tile, said support clip having a portion extending from an edge of said shelf into a mortar area between said thin brick tiles, said support clip connected to said building structure by a fastener extending through said support panel.

* * * * *